US009041537B2

(12) United States Patent
Taylor et al.

(10) Patent No.: US 9,041,537 B2
(45) Date of Patent: May 26, 2015

(54) PRE-ALARM FOR ABNORMAL MERCHANDISE HANDLING

(71) Applicant: InVue Security Products Inc., Charlotte, NC (US)

(72) Inventors: Gary A. Taylor, Fort Mill, SC (US); Nicholas M. Sedon, Weddington, NC (US); Larry T. McKinney, Huntersville, NC (US); Andrew W. Moock, Brecksville, OH (US); Jeffrey A. Grant, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 112 days.

(21) Appl. No.: 13/855,305

(22) Filed: Apr. 2, 2013

(65) Prior Publication Data

US 2013/0257616 A1 Oct. 3, 2013

Related U.S. Application Data

(60) Provisional application No. 61/619,486, filed on Apr. 3, 2012.

(51) Int. Cl.

| | |
|---|---|
| ***G08B 13/14*** | (2006.01) |
| ***G08B 21/02*** | (2006.01) |
| *G08B 25/00* | (2006.01) |

(52) U.S. Cl.

CPC ..... *G08B 13/1445* (2013.01); *G08B 13/1427* (2013.01); *G08B 21/0225* (2013.01); *G08B 21/0233* (2013.01); *G08B 25/002* (2013.01)

(58) Field of Classification Search

CPC ..... G08B 13/1445; G08B 13/1427; G08B 21/0225; A47F 7/024

USPC ..... 340/568.1, 568.2, 568.8

See application file for complete search history.

(56) References Cited

U.S. PATENT DOCUMENTS

| | | | |
|---|---|---|---|
| 5,030,941 | A | 7/1991 | Lizzi et al. |
| 5,051,725 | A | 9/1991 | Caccitolo |
| 5,963,131 | A | 10/1999 | D'Angelo et al. |
| 6,072,393 | A | 6/2000 | Todd |
| 6,133,830 | A | 10/2000 | D'Angelo et al. |

(Continued)

FOREIGN PATENT DOCUMENTS

| | | | |
|---|---|---|---|
| JP | 2007-249934 | A | 9/2007 |
| KR | 10-2009-0123333 | A | 12/2009 |
| WO | 2011094676 | A1 | 8/2011 |

OTHER PUBLICATIONS

Sung Chul Sang, International Search Report, Feb. 14, 2014, pp. 1-10, Korean Intellectual Property Office, Republic of Korea.

*Primary Examiner* — Thomas Mullen

(74) *Attorney, Agent, or Firm* — InVue Security Products Inc.

(57) ABSTRACT

Security systems and methods configured for use with an item of merchandise for retail display are provided. In one example, a security system includes at least one sensor operably coupled to the item of merchandise and at least one alarm module operably coupled to, and configured to communicate with, the at least one sensor. The alarm module is configured to generate a first alarm signal in response to the item of merchandise being handled in an abnormal manner, and the alarm module is further configured to generate a second alarm signal in response to the item of merchandise continuing to be handled in an abnormal manner. In general, the second alarm signal is different than the first alarm signal.

10 Claims, 2 Drawing Sheets

(56) References Cited

U.S. PATENT DOCUMENTS

| | | | | |
|---|---|---|---|---|
| 7,218,226 | B2 | 5/2007 | Wehrenberg | |
| 7,375,638 | B2 * | 5/2008 | Light et al. | 340/572.4 |
| 7,667,601 | B2 | 2/2010 | Rabinowitz et al. | |
| 7,800,490 | B2 | 9/2010 | Allen et al. | |
| 8,115,623 | B1 | 2/2012 | Green | |
| 8,212,672 | B2 | 7/2012 | Brenner | |
| 2001/0038330 | A1 | 11/2001 | Garcia | |
| 2002/0080036 | A1 | 6/2002 | Rabamme et al. | |
| 2003/0206106 | A1 | 11/2003 | Deconinck et al. | |
| 2004/0145471 | A1 | 7/2004 | Lawrenson et al. | |
| 2005/0040229 | A1 | 2/2005 | Andrews et al. | |
| 2007/0035391 | A1 | 2/2007 | Hamzy | |
| 2007/0146133 | A1 | 6/2007 | Wehrenberg | |
| 2007/0229259 | A1 | 10/2007 | Irmscher et al. | |
| 2008/0060241 | A1 | 3/2008 | Molinaro | |
| 2009/0079566 | A1 | 3/2009 | Goldstein et al. | |
| 2009/0174544 | A1 | 7/2009 | Allen et al. | |
| 2011/0074582 | A1 | 3/2011 | Alexis | |
| 2011/0215060 | A1 | 9/2011 | Niederhuefner | |
| 2011/0241870 | A1 | 10/2011 | Irmscher et al. | |
| 2012/0019383 | A1 * | 1/2012 | Fawcett et al. | 340/568.1 |
| 2012/0126981 | A1 | 5/2012 | Bawamia et al. | |
| 2012/0293330 | A1 | 11/2012 | Grant et al. | |

* cited by examiner

PRE-ALARM FOR ABNORMAL MERCHANDISE HANDLING

CROSS REFERENCE TO RELATED APPLICATIONS

This non-provisional application claims the benefit of U.S. Provisional Application No. 61/619,486, filed with the United States Patent and Trademark Office (USPTO) on Apr. 3, 2012, which is hereby incorporated by reference in its entirety.

FIELD OF THE INVENTION

Embodiments of the present invention relate to merchandise security, and, more particularly, to systems and methods for protecting retail display merchandise from theft.

BACKGROUND OF THE INVENTION

Known merchandise security systems for protecting an item of merchandise from theft include an alarm module and a sensor operatively coupled with the alarm module that is configured to be attached to the item of merchandise. Typically, the alarm module indicates an unsecured state of the merchandise by sounding an audible alarm in the event that the merchandise is separated from the sensor, although other notification techniques may be used such as visual or haptic. The audible alarm is generally loud enough to attract the attention of store personnel or security personnel that are not in the immediate vicinity of the merchandise display. Accordingly, false alarms are an annoyance and distracting to legitimate customers. If the security system includes a sensor cable or cord that extends between the alarm module and the sensor attached to the merchandise, a false alarm can occur if the sensor cord is extended beyond the normal elastic length of the cord such that excessive stress is applied to the adhesive attachment between the merchandise and the sensor. A false alarm can also occur if the sensor cord is extended an abnormal length such that excessive stress or strain is applied to any of the electrical connections between the sensor cord and the alarm module or sensor. If the security system includes an alarm module and a sensor that are operatively associated by wireless communication, a false alarm can occur if the merchandise (and the sensor attached to the merchandise) is inadvertently displaced or accidently moved a distance that exceeds the threshold distance of the wireless communication between the alarm module and the sensor.

Thus, a need exists for a security system that provides a pre-alarm in response to the item of merchandise being handled in an abnormal manner for protecting various retail display items of merchandise from theft. There is a further need for a security system for protecting an item of merchandise from theft that reduces the incidence of false alarms.

SUMMARY OF THE INVENTION

Embodiments of the present invention are directed to systems and methods for protecting retail display merchandise from theft. In one embodiment, a security system configured for operation with an item of merchandise for retail display is provided. The security system includes at least one sensor operably coupled to the item of merchandise and at least one alarm module operably coupled to, and configured to communicate with, the at least one sensor. The alarm module is configured to generate a first alarm signal (e.g., an audible signal) in response to the item of merchandise being handled in an abnormal manner. The alarm module is further configured to generate a second alarm signal (e.g., an audible signal) in response to the item of merchandise continuing to be handled in an abnormal manner, wherein the second alarm signal is different than the first alarm signal (e.g., greater volume, intensity, and/or duration than the first alarm signal). In one embodiment, the alarm module is configured to deactivate the first alarm signal and/or the second alarm signal based upon the item of merchandise no longer being handled in an abnormal manner.

According to one aspect, the at least one sensor comprises a cable operably coupled to the alarm module. The cable may be configured to establish a sense loop between the alarm module and the sensor, wherein the alarm module is configured to detect when the sensor has been separated from the item of merchandise. The alarm module may be configured to detect when the cable has been extended beyond a normal length but less than a first threshold length and to generate the first alarm signal in response to the cable being extended beyond the normal length. In addition, the alarm module may be configured to detect when the cable has been extended beyond the first threshold length but less than a second threshold length and to generate the second alarm signal in response to the cable being extended beyond the first threshold length. The alarm module may be further configured to detect when the cable has been extended beyond the second threshold length and to generate a third alarm signal in response to the cable being extended beyond the second threshold length, wherein the third alarm signal is different than the second alarm signal. The second alarm signal may have a greater volume, intensity, and/or duration than the first alarm signal, and the third alarm signal may have a greater volume, intensity, and/or duration than the second alarm signal.

According to another aspect, the at least one sensor and the alarm module are operably coupled by wireless communication. The alarm module may be configured to determine whether the sensor is located within a predetermined location (e.g., distance or perimeter). The alarm module may be further configured to detect when the sensor has been moved beyond a normal location but less than a first threshold location and to generate the first alarm signal in response to the sensor being moved beyond the normal location. The alarm module may also be configured to detect when the sensor has been moved beyond the first threshold location but less than a second threshold location and to generate the second alarm signal in response to the sensor being moved beyond the first threshold location. Furthermore, the alarm module may be configured to detect when the sensor has been moved beyond the second threshold location and to generate a third alarm signal in response to the sensor being moved beyond the second threshold location, wherein the third alarm signal is different than the second alarm signal. In one aspect, the second alarm signal has a greater volume, intensity, and/or duration than the first alarm signal, and the third alarm signal has a greater volume, intensity, and/or duration than the second alarm signal.

In one embodiment, a method for protecting an item of electronic merchandise from theft is provided. The method includes generating a first alarm signal with an alarm module in response to the item of merchandise being handled in an abnormal manner. The method further includes generating a second alarm signal with the alarm module in response to the item of merchandise continuing to be handled in an abnormal manner. The second alarm signal is different than the first alarm signal.

According to various aspects of the method, the at least one sensor comprises a cable operably coupled to the alarm module, and the method further comprises detecting when the cable has been extended beyond a normal length but less than a first threshold length and generating the first alarm signal in response to the cable being extended beyond the normal length. The method may also include detecting when the sensor has been moved beyond a normal location but less than a first threshold location and generating the first alarm signal in response to the sensor being moved beyond the normal location. In one example, generating a second alarm signal comprises generating a second alarm signal that has a greater volume, intensity, and/or duration than the first alarm signal.

In one embodiment, the method further includes detecting when a cable coupling the sensor and the alarm module has been extended beyond a normal length but less than a first threshold length and generating the first alarm signal in response to the cable being extended beyond the normal length. The method may further include detecting when the cable has been extended beyond the first threshold length but less than a second threshold length and generating the second alarm signal in response to the cable being extended beyond the first threshold length. In another embodiment, such as where wireless communication is employed, the method includes detecting when the sensor has been moved beyond a normal location but less than a first threshold location and generating the first alarm signal in response to the sensor being moved beyond the normal location. The method may also include detecting when the sensor has been moved beyond the first threshold location but less than a second threshold location and generating the second alarm signal in response to the sensor being moved beyond the first threshold location.

DETAILED DESCRIPTION OF THE PREFERRED EMBODIMENTS

Embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art Like numbers refer to like elements throughout, and prime notation and multiple prime notations are used to indicate similar elements in alternative embodiments.

Embodiments of the present invention are directed to merchandise security systems and methods for providing a pre-alarm indication in the event that an item of merchandise on display is being handled in a manner inconsistent with the way a typical customer interacts with the merchandise. For example, a pre-alarm may sound when the sensor cord of the sensor attached to the item of merchandise is extended to an abnormal length. The abnormal extension may indicate an attempt to steal the merchandise. However, an abnormal extension may also result from a legitimate purchaser inadvertently dropping the merchandise off the display, or alternatively, accidently moving the merchandise a distance from the alarm module that exceeds the normal elastic length of the sensor cord. In another embodiment, the merchandise security system may include a wireless sensor and a pre-alarm may sound when the merchandise and the wireless sensor attached to the merchandise are moved an atypical distance from the alarm module. Thus, embodiments of the present invention are directed to techniques for providing a "pre-alarm" or warning signal to a customer that the item of merchandise is being handled in an abnormal manner. The customer may then rectify the situation by ceasing handling of the item of merchandise in an abnormal manner. Continued abnormal handling of the item of merchandise will result in at least a second and more pronounced alarm signal.

Figure 1:
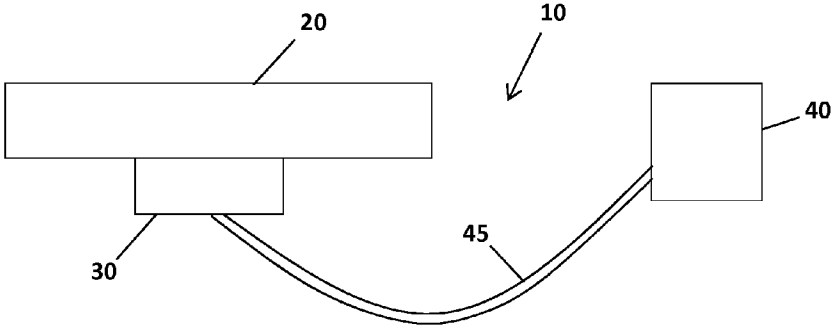
FIG. 1 is a schematic view depicting a security system for protecting retail display merchandise from theft in accordance with one embodiment of the present invention.

According to various embodiments of the present invention, a merchandise security system 10 for protecting an item of merchandise 20 from theft includes an alarm module 40 and a sensor 30 operatively coupled to the alarm module. The sensor 30 is attached or affixed to the item of merchandise 20 in any suitable manner, for example, by an adhesive. As shown in FIG. 1, the security system 10 may further include a sensor cable or cord 45 that extends between and electrically connects the alarm module 40 and the sensor 30. Alternatively, the alarm module 40 and the sensor 30 may be operatively coupled by wireless communication, as shown in FIG. 2.

In one embodiment shown in FIG. 1, the security system 10 includes an alarm module 40, a sensor 30 attached to an item of merchandise 20, and a sensor cord 45 extending between and electrically connecting the alarm module and the sensor. The sensor cord 45 may establish a sense loop between the alarm module 40 and a sensor element (e.g. a proximity or limit switch) of the sensor 30 that monitors whether the item of merchandise 20 is attached to the sensor. The alarm module 40 is configured to activate an audible alarm if the merchandise 20 is separated from the sensor 30. The sensor cord 45 may be extensible and retractable relative to the alarm module 40 so that the item of merchandise 20 can be handled (i.e. examined and operated) by a potential purchaser. However, the alarm module 40 may activate a "false alarm" if the sensor cord 45 is extended beyond a length that is typical of a normal customer interaction with the merchandise 20. More particularly, abnormal extension of the sensor cord 45 can result in excessive stress and/or strain temporarily being applied to the adhesive connection between the sensor 30 and the merchandise 20, or to the electrical conductors within the sensor cord, or to the electrical connections between the sensor cord and the alarm module or the sensor. In order to minimize false alarms, the alarm module 40 is configured to activate an audible pre-alarm in the event that the sensor cord 45 is extended to an abnormal length.

The pre-alarm may include multiple thresholds so as to minimize the annoyance and distraction to customers in the vicinity of the security system 10. For example, the alarm module 40 may generate an audible first pre-alarm having a minimal volume, intensity and/or duration if the sensor cord 45 is extended beyond the normal extension but less than a first threshold length. The alarm module 40 may generate an audible second pre-alarm having a volume, intensity and/or duration that is greater than the first pre-alarm if the sensor cord 45 is further extended beyond the first threshold length, but less than a second threshold length. Similarly, the alarm module 40 may generate an audible third pre-alarm having a volume, intensity and/or duration that is greater than the second pre-alarm if the sensor cord 45 is further extended beyond the second threshold length. As such, the first pre-alarm may provide a gentle reminder to a legitimate customer that the merchandise 20 is tethered to the display and is not intended to be moved beyond a predetermined distance from the alarm module 40. If the customer ignores the first pre-alarm and continues to move the merchandise 20 further from the alarm module 40 than the first threshold length, the second pre-alarm provides a more forceful suggestion to the customer to return the merchandise 20 to within the predetermined distance from the alarm module. If the customer ignores the second pre-alarm and continues to move the merchandise 20 further from the alarm module 40 than the second threshold length, the third pre-alarm provides an indication to store personnel and/or security personnel that the customer is interacting with the merchandise in a manner that may cause significant damage to the security system even in the absence of a potential theft. Of course, the alarm module 40 may perform additional and/or other communications functions upon an alarm signal, as will be appreciated by those skilled in the art, including for example, disabling one or more functions, capabilities or operations of the item of merchandise 20.

Figure 2:
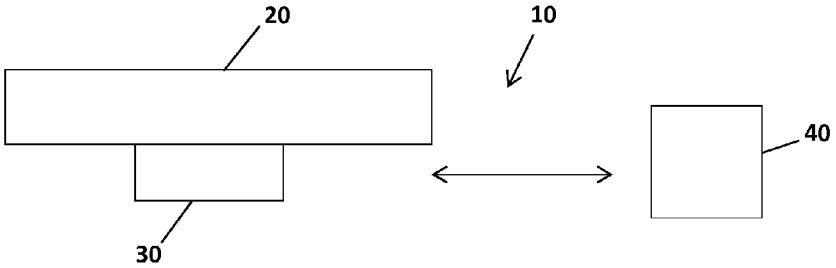
FIG. 2 is a schematic view depicting a security system for protecting retail display merchandise from theft in accordance with one embodiment of the present invention.

In another embodiment, the security system 10 includes an alarm module 40 and a sensor 30 attached to an item of merchandise with the sensor operatively coupled to the alarm module by wireless communication, as shown in FIG. 2. The wireless communication may establish a sense loop between the alarm module 40 and the sensor 30 that monitors whether the sensor (and thus, the item of merchandise 20) is located within a predetermined distance from the alarm module and activates an audible alarm if the sensor and merchandise are beyond the predetermined location. The sensor 30 and the alarm module 40 are operatively coupled by wireless communication so that the item of merchandise 20 can be handled (e.g. examined and operated) by a potential purchaser without the physical restraint of a tether connecting the sensor (and thus, the item of merchandise) with the alarm module. However, the alarm module 40 may activate a "false alarm" if the sensor 30 and the merchandise 20 are inadvertently or accidently moved beyond a distance or outside a perimeter that is typical of a normal customer interaction with the merchandise.

Figure 3:
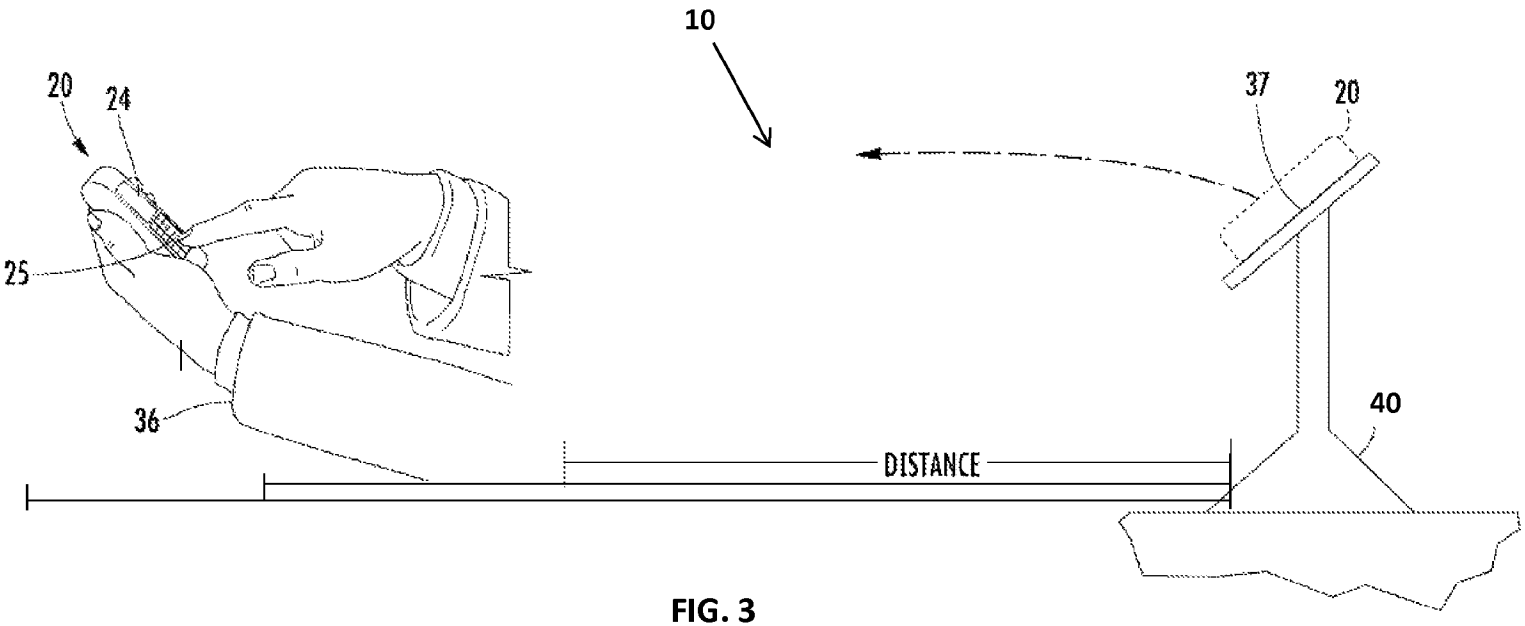
FIG. 3 is a schematic view depicting a security system for protecting retail display merchandise from theft in accordance with one embodiment of the present invention.

In order to minimize false alarms, the alarm module 40 is configured to activate an audible pre-alarm in the event that the sensor 30 and the merchandise 20 are moved to an abnormal location (e.g., based on a pre-determined threshold distance or perimeter). As previously described, the pre-alarm may include multiple thresholds so as to minimize the annoyance and distraction to customers in the vicinity of the security system 10. For example, the alarm module 40 may generate an audible first pre-alarm having a minimal volume, intensity and/or duration if the sensor 30 and merchandise 20 are moved beyond the normal location, but less than a first threshold location. The alarm module 40 may generate an audible second pre-alarm having a volume, intensity and/or duration that is greater than the first pre-alarm if the sensor 30 and merchandise 20 are further moved beyond the first threshold location, but within than a second threshold location. For example, FIG. 3 shows a customer 36 who has moved an item of merchandise 20 beyond a first shorter distance and a second longer distance measured between the item of merchandise 20 and the alarm module 40. Similarly, the alarm module 40 may generate an audible third pre-alarm having a volume, intensity and/or duration that is greater than the second pre-alarm if the sensor 30 and merchandise 20 are moved beyond the second threshold location. For instance, FIG. 3 shows a third distance measured between the item of merchandise 20 and the alarm module 40.

The item of merchandise may be any electronic device, such as cellular telephones, portable, personal computers, for example laptop, notebook, mini-notebook, sub-notebook and netbook type computers, as well as personal data assistant (PDA) type devices. For example, FIG. 3 illustratively shows the item of merchandise 20 as a mobile wireless communications device, and more specifically, a cellular telephone. In the instance where a cord 45, cable, or tether is used, it is understood that the item of merchandise 20 need not be an electronic item of merchandise. For example, the item of merchandise 20 may be an article of jewelry, an article of clothing, an item of pre-recorded media (e.g. CD, DVD, etc.) or the like.

The item of merchandise 20 and alarm module 30 may include wireless communications circuitry for wireless communication therebetween, which may include, for example, one or more wireless transceivers for transmitting and receiving cellular, WiFi, and/or Bluetooth communications. The item of electronic merchandise 20 and/or sensor 30 may also include various means for locating the position of the device, for example, a Global Positioning System (GPS) satellite receiver, gyroscopes, and/or accelerometers, as are known in the art. Thus, the sensor 30 may include means for locating the item of merchandise 20. The item of electronic merchandise 20 may further include a display 24, and a plurality of input devices 25 for accepting user inputs (see e.g., FIG. 3), as will also be appreciated by those skilled in the art. Where a cord 45 is employed, the cord may include one or more conductors for facilitating electrical communication with the item of merchandise 20 and sensor 30. For instance, the cord 45 may include a plurality of conductors for providing electrical and security signals to the item of merchandise 20 and sensor 30.

Various techniques may be used to determine the location or position of the item of merchandise 20 and/or sensor 30 in order to determine whether the item is being handled abnormally, such as where the item or sensor is determined to be located in a position beyond a predetermined distance or perimeter from the alarm module 40. For example, one or a combination of GPS satellite receiver, gyroscopes, and/or accelerometers may be used to locate the item and/or sensor, which may be used to determine whether the item of merchandise 20 or sensor 30 is located an abnormal distance or perimeter from the alarm module 40. In particular embodiments, the distance traveled by the item of merchandise 20 or sensor 30 from the alarm module 40 is based upon inertial navigation system (INS) techniques, for example, dead reckoning, as will be appreciated by those skilled in the art. Once the location of the item of merchandise 20 or sensor 30 has been determined, the alarm module 40 may include a controller and associated logic to determine whether the item 20 or sensor 30 is positioned beyond an allowable distance from the alarm module. In one embodiment, the item of merchandise 20 may include a controller for determining its location and communicate with the alarm module 40. In particular examples, the controller utilizes conventional motion processing algorithms to determine the distance traveled by the item of electronic merchandise 20 away from the alarm module 40 based on the location of the item. For example, the item of merchandise 20 may include a controller configured to determine the orientation and acceleration of the item, which may in turn be used to determine a distance from the alarm module 40, such as disclosed in U.S. application Ser. No. 13/474,862, filed May 18, 2012, entitled Systems and Methods for Protecting Retail Display Merchandise from Theft, which is hereby incorporated by reference in its entirety. Of course, the threshold length, distance, or perimeter may be set to any desired length, distance, or perimeter, or alternatively, another variable may be used, such as time, acceleration, orientation, etc. in order to determine whether the item of merchandise 20 is being handled in an abnormal manner. Other techniques to determine whether the item of merchandise 20 is being handled differently include detecting an abnormal or weak wireless signal strength detected by the alarm module, abnormal volume of a listening microphone detected by the alarm module, or abnormal intensity of an optical sensor "watching" the item of merchandise.

In the instance where a cord 45 is employed, the cord may be elastic or otherwise variable in length such that an acceptable variation in length can be predetermined. In one embodiment, the length of the cord may be determined based on the location of the item of merchandise 20 and/or sensor 30 using any of the aforementioned techniques. Thus, using a predetermined acceptable length of the cord 45, the location of the item of merchandise 20 and/or sensor 30 with respect to the alarm module 40 may be determined and compared to the acceptable length. As noted above, various threshold lengths may be used to provide escalating alarm signals should one or more of the thresholds be exceeded. In other embodiments, the physical forces applied to the cord 45 may be measured to determine whether the cord is being handled abnormally, such as based on tension in the cord.

Alarm module 40 may stand alone, or alternatively, may be permanently attached to, removably attached to, or otherwise operably coupled with a cradle, display stand, base or the like 37 (see e.g., FIG. 3). Thus, the item of merchandise 20 and sensor 30 may be configured to rest on the cradle 37 and removed therefrom for inspection by a customer. In a particular embodiment, the cradle 37 is also a charging station for providing power to the item of merchandise 20 and/or sensor 30, such as, for example, via hard wiring through the cord 45, contact charging, or inductive charging. Moreover, the sensor 30 may be any suitable sensor configured to detect the separation of the item of merchandise 20 from the sensor, such as a pressure, an electrical, an optical, or a magnetic sensor as would be appreciated by those skilled in the art. In some embodiments, the sensor 30 is removably attached to the item of merchandise 20, such as with a pressure sensitive adhesive. Other types of adhesives may be used, and other mounting or attachment elements may be used, such as interlocking features, magnetically attractive strips, etc. as will be appreciated by those skilled in the art. In other embodiments, the sensor 30 may be integrated with the item of merchandise.

A related method according to one embodiment of the present invention is provided for protecting a retail display item of electronic merchandise to be evaluated and operated by a customer when considering whether to purchase the merchandise. As noted above, an item of merchandise and sensor may be operably coupled to, and in communication with an alarm module. The method may include generating a first alarm signal with the alarm module in response to the item of merchandise being handled in an abnormal manner. The method may further include generating a second alarm signal with the alarm module in response to the item of merchandise continuing to be handled in an abnormal manner, the second alarm signal being different than the first alarm signal. In one embodiment, the method further includes detecting when a cable coupling the sensor and the alarm module has been extended beyond a normal length but less than a first threshold length and generating the first alarm signal in response to the cable being extended beyond the normal length. The method may further include detecting when the cable has been extended beyond the first threshold length but less than a second threshold length and generating the second alarm signal in response to the cable being extended beyond the first threshold length. In another embodiment, such as where wireless communication is employed, the method includes detecting when the sensor has been moved beyond a normal location but less than a first threshold location and generating the first alarm signal in response to the sensor being moved beyond the normal location. The method may also include detecting when the sensor has been moved beyond the first threshold location but less than a second threshold location and generating the second alarm signal in response to the sensor being moved beyond the first threshold location.

Many modifications and other embodiments of the invention will be readily apparent to one skilled in the art having the benefit of the teachings presented in the foregoing descriptions and the associated drawings. Therefore, it is understood and appreciated that the invention is not to be limited to the specific embodiments disclosed herein, and that modifications to the disclosed embodiments and other undisclosed embodiments are intended to be included within the scope of the appended claims.

That which is claimed is:

1. A security system configured for operation with an item of merchandise for retail display, the security system comprising:

at least one sensor operably coupled to the item of merchandise; and at least one alarm module operably coupled to, and configured to communicate with, the at least one sensor, the alarm module configured to generate a first alarm signal in response to the item of merchandise being handled in an abnormal manner, the alarm module further configured to generate a second alarm signal in response to the item of merchandise continuing to be handled in an abnormal manner, the second alarm signal being different than the first alarm signal, wherein the at least one sensor comprises a cable operably coupled to the alarm module, and wherein the alarm module is configured to detect when the cable has been extended beyond a normal length but less than a first threshold length and to generate the first alarm signal in response to the cable being extended beyond the normal length.

2. The security system according to claim 1, wherein the cable is configured to establish a sense loop between the alarm module and the sensor, and wherein the alarm module is configured to detect when the sensor has been separated from the item of merchandise.

3. The security system according to claim 1, wherein the alarm module is configured to detect when the cable has been extended beyond the first threshold length but less than a second threshold length and to generate the second alarm signal in response to the cable being extended beyond the first threshold length.

4. The security system according to claim 3, wherein the alarm module is configured to detect when the cable has been extended beyond the second threshold length and to generate a third alarm signal in response to the cable being extended beyond the second threshold length, the third alarm signal being different than the second alarm signal.

5. The security system according to claim 3, wherein the second alarm signal has a greater volume, intensity, and/or duration than the first alarm signal, and wherein the third alarm signal has a greater volume, intensity, and/or duration than the second alarm signal.

6. The security system according to claim 1, wherein the second alarm signal has a greater volume, intensity, and/or duration than the first alarm signal.

7. The security system according to claim 1, wherein the first alarm signal and the second alarm signal comprise an audible signal.

8. The security system according to claim 1, wherein the alarm module is configured to deactivate the first alarm signal or the second alarm signal based upon the item of merchandise no longer being handled in an abnormal manner.

9. A method for protecting an item of electronic merchandise from theft comprising at least one sensor operably coupled to an alarm module with a cable, the method comprising:

detecting when the cable has been extended beyond a normal length but less than a first threshold length;

generating a first alarm signal with the alarm module in response to the cable being extended beyond the normal length;

detecting when the cable has been extended beyond the first threshold length but less than a second threshold length; and generating a second alarm signal with the alarm module in response to the cable being extended beyond the first threshold length, the second alarm signal being different than the first alarm signal.

10. The method according to claim 9, wherein generating a second alarm signal comprises generating a second alarm signal that has a greater volume, intensity, and/or duration than the first alarm signal.

* * * * *